US008899567B2

(12) United States Patent
Nagayama

(10) Patent No.: US 8,899,567 B2
(45) Date of Patent: Dec. 2, 2014

(54) SECTION SIGNATURE ACCUMULATING APPARATUS AND SECTION SIGNATURE ACCUMULATING METHOD

(75) Inventor: Kenichi Nagayama, Tokyo (JP)

(73) Assignee: Kabushiki Kaisha Tokyo Kikai Seisakusho (JP)

( * ) Notice: Subject to any disclaimer, the term of this patent is extended or adjusted under 35 U.S.C. 154(b) by 33 days.

(21) Appl. No.: 13/587,756

(22) Filed: Aug. 16, 2012

(65) Prior Publication Data

US 2014/0048998 A1 Feb. 20, 2014

(51) Int. Cl.
*B41F 13/54* (2006.01)

(52) U.S. Cl.
USPC .... 270/21.1; 270/5.03; 270/52.09; 270/52.12

(58) Field of Classification Search
USPC ..... 270/52.14, 52.15, 52.16, 52.17, 52.18, 270/52.19, 52.2, 52.21, 52.22, 52.23, 52.24, 270/52.25, 52.26, 52.27, 52.28, 52.29, 270/52.09, 5.02, 5.03
See application file for complete search history.

(56) References Cited

U.S. PATENT DOCUMENTS

| | | | | |
|---|---|---|---|---|
| 2,361,459 | A * | 10/1944 | Corbin | 271/184 |
| 3,531,108 | A * | 9/1970 | Gingras et al. | 271/305 |
| 4,022,455 | A * | 5/1977 | Newsome et al. | 270/52.29 |
| 4,388,994 | A * | 6/1983 | Suda et al. | 209/564 |
| 4,593,893 | A * | 6/1986 | Suter | 270/52.12 |
| 5,435,534 | A * | 7/1995 | Linkowski et al. | 270/51 |
| 6,257,566 | B1 * | 7/2001 | Dooley | 270/52.18 |
| 7,665,720 | B2 * | 2/2010 | Mori et al. | 270/52.16 |
| 7,963,515 | B2 * | 6/2011 | Dawley et al. | 270/52.09 |
| 8,356,809 | B2 * | 1/2013 | Dawley et al. | 270/21.1 |
| 8,596,632 | B2 * | 12/2013 | Silberbauer et al. | 270/52.19 |
| 8,608,149 | B2 * | 12/2013 | Schuler Cossette | 270/21.1 |
| 2007/0062392 | A1 * | 3/2007 | Ratz | 101/227 |
| 2007/0158893 | A1 * | 7/2007 | Mori et al. | 270/52.18 |
| 2010/0276878 | A1 * | 11/2010 | Bichsel et al. | 271/264 |

FOREIGN PATENT DOCUMENTS

| | | |
|---|---|---|
| JP | 2001-048398 | 2/2001 |
| JP | 2002-193545 | 7/2002 |
| JP | 2007-076923 | 3/2007 |

* cited by examiner

*Primary Examiner* — Patrick Mackey
(74) *Attorney, Agent, or Firm* — Clark Hill PLC

(57) ABSTRACT

A section signature stacking body where one or more section signatures are stacked in a proper appearance is formed and carried out. A section signature accumulating apparatus includes: a first carrying part configured to receive and carry the manufactured section signature; a classifying/carrying part configured to classify N (N is an integer equal to or larger than 2 section signatures having the same configuration transported by the first carrying part to N different section signature accumulating parts one by one to carry the section signatures; N section signature accumulating parts configured to stock the section signatures carried by the classifying/carrying part and form a section signature stacking body where one or more sections signatures are stacked; and a second carrying part configured to carry N section signature stacking bodies discharged from the N section signature accumulating parts, respectively.

4 Claims, 5 Drawing Sheets

SECTION SIGNATURE ACCUMULATING APPARATUS AND SECTION SIGNATURE ACCUMULATING METHOD

BACKGROUND OF THE INVENTION

The present invention relates to: a section signature accumulating apparatus which manufactures at least folding-in-two sections signature with one sheet or a plurality of overlaid sheets, and overlays one or more manufactured section signatures to form and carry out a section signature stacking body, and a section signature accumulating method.

In recent years, in order to show off the digital printing features, printing media whose configurations are subdivided according to regions or requests of readers and which are formed by combining a plurality of different section signatures are being required to be manufactured. For example, in the field of newspapers, section signature stacking bodies configured by overlaying a plurality of kinds of section signatures, such as a section signature where news of the entire society are reported, a section signature where local news are reported, and a section signature where information (for example, information on sports, travels, restaurants, food materials, or the like) desired by readers are reported, are required to be formed. The section signature stacking body formed in this way may also be made to form a multi-section newspaper signature by, if necessary, folding the section signature stacking body into two and binding the section signature stacking body into a bundle with outer section signatures thereof using a post-processing apparatus.

Meanwhile, technologies including apparatuses (or Methods) capable of overlapping a plurality of kinds of section signatures to form a section signature stacking body are disclosed in Patent Literatures 1 and 2. Further, a technology disclosed in the following Patent Literature 3, as an apparatus for stably discharging gathered objects to a stacker part, is known.

According to the method and apparatus disclosed in Patent Literature 1, "(1) continuously printed sheets are continuously supplied to a first collection station one by one. Sheets allocated to one common signature are disposed to vertically overlap each other, and (are collected) to form a sheet piling body. (2) The finished sheet piling body is transported from the first collection station. (3) In order to finish a signature, the finished sheet piling body is folded at a center thereof in a first folding station. (4) The signature is disposed on a signature piling body including a plurality of signatures which has already been printed and folded in a second collection station. (5) If all signatures of a newspaper are completely equipped, the signature piling body is folded at a center thereof in a second folding station". Here, the second collection station corresponds to the section accumulating apparatus.

In the method and apparatus disclosed in Patent Literature 2, "(1) opposite surfaces of an endless paper web are digitally printed by a digital printing machine through a known method. (2) The paper web is carried by a pulling roller in an area of a first carrying path at a predetermined speed and with a predetermined tensile force, the endless paper web is supplied to a transverse cutter behind the pulling roller, and the transverse cutter divides the endless paper web into a paper. (3) The paper is weakened by a groove roller before being folded in a continuous folding machine, and then is folded accurately along a groove line in the continuous folding machine. (4) A second carrying path is installed behind the continuous folding machine, and includes a gathering station at a rear area when viewed from the carrying direction, and the paper is gathered as a complete newspaper booklet at the gathering station. (5) At a distal end of the second carrying path, the newspaper booklet is supplied to a first working station which is a subsequent processing means by a carry-out part. The carrying plane of the newspaper booklet is inclined in the first working station. (6) The booklet supplied to the first working station is positioned on a catch element by its own self-weight thereof in the first working station. A plurality of folded newspaper booklets may be gathered at the first working station, instead of just one newspaper booklet. (7) After (when) the plurality of folded newspaper booklets is gathered, the catch element drops, and the plurality of gathered newspaper booklets is slid to a second working station having a folding machine via a cascade due to its own self-weight thereof because of the above-described inclination. (8) In the second working station, the newspaper booklet is folded at a center thereof or has a bundling part". Here, the first working station corresponds to the section accumulating apparatus.

Further, the apparatus disclosed in Patent Literature 3 relates to a discharge technology for discharging a plurality of kinds of papers overlapped one by one in a predetermined sequence to form one gathering object to a stacker part (accumulating part), and the gathering object delivered from a gathering/carrying part is guided to a paper ejection guide plate to be guided between a pair of paper ejection rollers, the stacker part receives a discharging force due to rotating forces of the pair of paper ejection rollers, and opposite lower surfaces of the gathering object are guided to compulsory guide surfaces of a pair of paper ejection posture forcing pedestals to be shifted to an upper side, so that the gathering object is discharged while taking a V-shaped aviation posture when viewed from the front side. In addition, in the case of a weak gathering object (including light papers or a few sheets of papers), as the compulsory guide surfaces of the pair of paper ejection posture forcing pedestals face upward, a bending force is applied to the gathering object to be discharged while the gathering object takes a V-shaped aviation posture having a large angle, whereas in the case of a strong gathering object (including heavy papers or many sheets of papers), as the compulsory guide surfaces of the pair of paper ejection posture compulsory pedestals face downward, a bending force is rarely applied to the gathering object to be discharged while the gathering object takes a V-shaped or horizontal aviation posture having a small angle, whereby a difference in leaps is not generated regardless of the strength of the gathering object, the arrangement of the papers is stable, and the gathering object is discharged to the stacker part while the paper is neither jammed nor wrinkled.

[Patent Literature 1] Japanese Patent Application Laid-Open (JP-A) No. 2002-193545

[Patent Literature 2] JP-A No. 2007-76923

[Patent Literature 3] JP-A No. 2001-48398

SUMMARY OFF THE INVENTION

According to the section signature accumulating parts included in the above Patent Literatures 1 and 2, a section signature stacking body is formed by stacking a necessary number of section signatures, each of which is manufactured to be one copy.

Further, a technology of manufacturing a newspaper signature with a rotation/folding unit is described in the specification of a patent application (JP-A No. 2010-019286) filed by the applicant of the present invention. According to the newspaper manufacturing apparatus described in the patent specification, a plurality of newspaper signatures having the same configuration is continuously discharged at a time.

However, an apparatus and a method for stacking a plurality of continuously manufactured newspaper signatures (section signatures) having the same configuration one by one to form a section signature stacking body, and carrying out the section signature stacking body have not existed yet.

In addition, the technology disclosed in the above Patent Literature 3 is directed to discharge a gathering object to a stacker part while the gathering object takes a V-shaped aviation posture when viewed from the front side, and an angle of the V shape is changed according to the strength of the gathered object.

However, if the section signature folded in two in a direction perpendicular to a discharge direction takes a V-shaped posture, the entire section signature is not smoothly curved but is unnecessarily folded in a direction perpendicular to the folded lines at unspecific locations of the folded points, deteriorating quality of the section signature.

The present invention was made in view of the above problems of the conventional techniques, and an object of the present invention is to provide a section signature accumulating apparatus which classifies section signatures manufactured N by N (N is an integer equal to or larger than 2) one by one, stocks the section signatures, and forms and carries out N section signature stacking bodies (including the case of one section signature, which is the same in the following) where one or more section signatures are stacked in a proper posture, and a section signature accumulating method.

The present invention aims for accomplishing the above object by the configuration and method described in the claims), and has the following configurations. Namely, a section signature accumulating apparatus according to the present invention is a section signature accumulating apparatus for manufacturing at least folding-in-two sections signature with one sheet or a plurality of overlaid sheets, and stacking one or more manufactured section signatures to form and carry out a section signature stacking body, including: a first carrying part configured to receive and carry the manufactured section signature; a classifying/carrying part configured to classify N (N is an integer equal to or larger than 2) section signatures having the same configuration transported by the first carrying part to N different section signature accumulating parts one by one to carry the section signatures; N section signature accumulating parts configured to stock the section signatures carried by the classifying/carrying part and form a section signature stacking body where one or more section signatures are stacked; and a second carrying part configured to carry N section signature stacking bodies discharged from the N section signature accumulating parts, respectively.

Further, the section signature accumulating apparatus according to the present invention may include: a speed changing/carrying part configured to change speeds of the manufactured section signatures to suitable speeds before the section signatures are carried to the section signature accumulating parts to carry the section signatures.

Further, in the section signature accumulating apparatus according to the present invention, the N section signature accumulating parts are installed side by side at a suitable interval in the same direction as a carrying direction of the section signatures, and a time gap between timings when the section signatures reach the section signature accumulating parts, respectively, is made small by sequentially classifying and carrying the section signatures from the section signature accumulating part located at a downstream side in the carrying direction to the section signature accumulating part located at an upstream side with the classifying/carrying part.

Further, a section signature accumulating method according to the present invention is a section signature accumulating method of manufacturing at least folding-in-two sections signature with one sheet or a plurality of overlaid sheets, and stacking one or more manufactured section signatures to form and carry out a section signature stacking body, including: a first carrying step of receiving and carrying section signatures manufactured N by N and having the same configuration; a classifying/carrying step of classifying and carrying the section signatures to N different section signature accumulating parts one by one; a section signature accumulating step of stocking the classified and carried section signatures and forming a section signature stacking body where one or more section signatures are stacked in the section signature accumulating parts, respectively; and a second carrying step of carrying the formed section signature stacking body.

Further, in the section signature accumulating method according to the present invention, any one of a first carrying step of receiving and carrying section signatures manufactured N by N and having the same configuration; and a classifying/carrying step of classifying and carrying the section signatures to N different section signature accumulating parts, respectively, includes a speed changing/carrying step of changing carrying speeds of the section signatures.

According to the present invention, section signatures manufactured N by N can be classified to N different section signature accumulating parts one by one by a classifying/carrying part, and stocked in the N section signature accumulating parts to form N section signature stacking bodies where one or more section signatures are stacked, and the formed N section signature forming bodies can be carried out.

Further, when a speed at which a section signature is introduced into the section signature accumulating part is low, a leading end of the section signature may droop down due to its own self-weight thereof, contact a bottom plate or the section signature having arrived previously, and be bent or wrinkled before the entire section signature enters the section signature accumulating part. Meanwhile, when the introduction speed is high, a leading end of the section signature may rapidly collide with a side wall on the front side, cause a flaw in the section signature or be popped from a side wall on the front side while generating a wrinkle. However, in the present invention, the section signature delivered from a preprocessing unit is introduced into the section signature accumulating part after a carrying speed thereof is changed to a suitable speed by a speed changing/carrying part before the section signature is carried to the section accumulating part, and thus a section signature stacking body having a proper appearance can be formed without causing a flaw or a bending portion in the section signature.

Further, in the present invention, the section signature accumulating part is installed in parallel to a carrying direction of the section signature delivered from the preprocessing unit, and is configured such that the section signature delivered from the preprocessing unit may be carried from a section accumulating part located on a downstream side of the carrying direction to a section accumulating part located on an upstream side in sequence by the classifying/carrying part. In addition, the section signature accumulating parts are installed at a suitable interval such that a time gap between timings when the section signatures reach the section signature accumulating parts becomes smaller. Thus, a time gap between timings when a plurality of section signature stacking bodies is finished is small, and the section signature stacking bodies are loaded on a second carrying part for carrying out the section signature stacking bodies substantially simultaneously. Therefore, in the present invention, there is no need to install a plurality of carrying parts which is operated at timings different from section signature stacking bodies in order to carry out N section signature stacking bodies and the section signature stacking bodies may be carried out while being positioned on one carrying part, and thus the apparatus can be simplified and one apparatus can be sufficient for the following process.

DESCRIPTION OF THE INVENTION

Hereinafter, preferred embodiments for carrying out the present invention are described below with reference to the drawings. Further, the following embodiments are not intended to limit the inventions set forth in the claims, and the combinations of features described in the embodiments are not all necessarily indispensable for the means for solving the problem provided by the invention.

Figure 1:
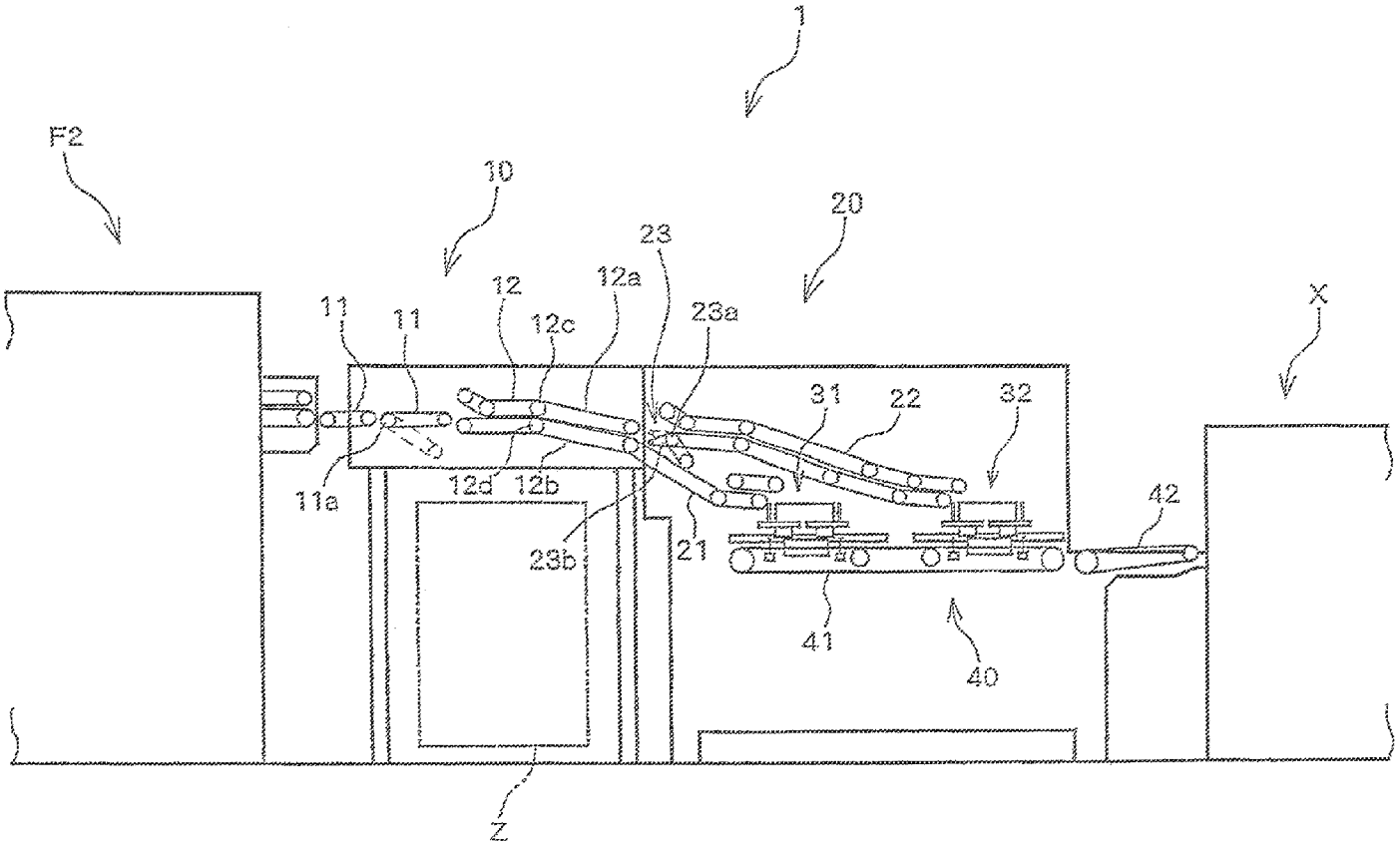
FIG. 1 is a schematic front view of a section signature accumulating apparatus 1 according to a first embodiment.
Figure 2:
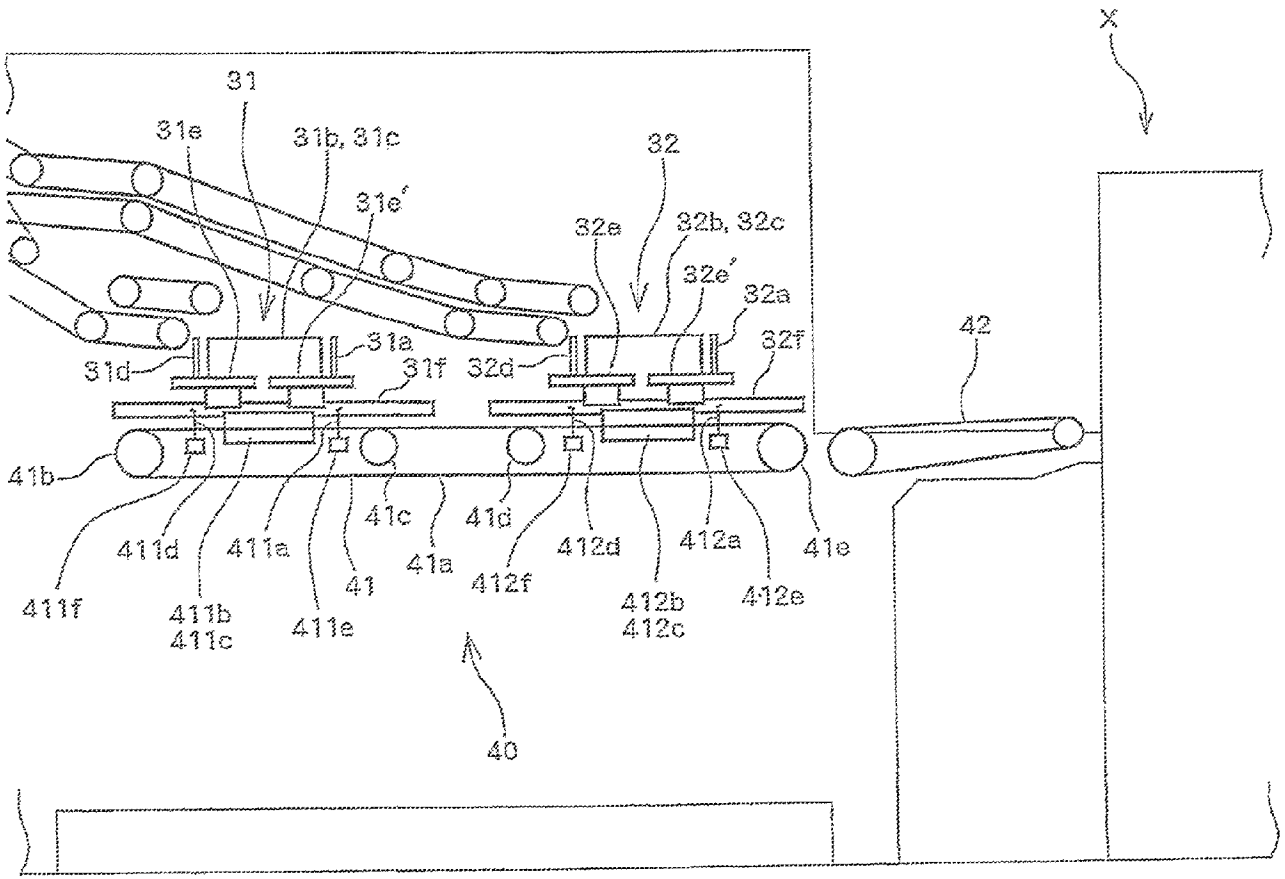
FIG. 2 is an enlarged view of section signature accumulating parts 31 and 32 and a second carrying part 40 of the section signature accumulating apparatus 1 according to the first embodiment illustrated in FIG. 1.
Figure 3:
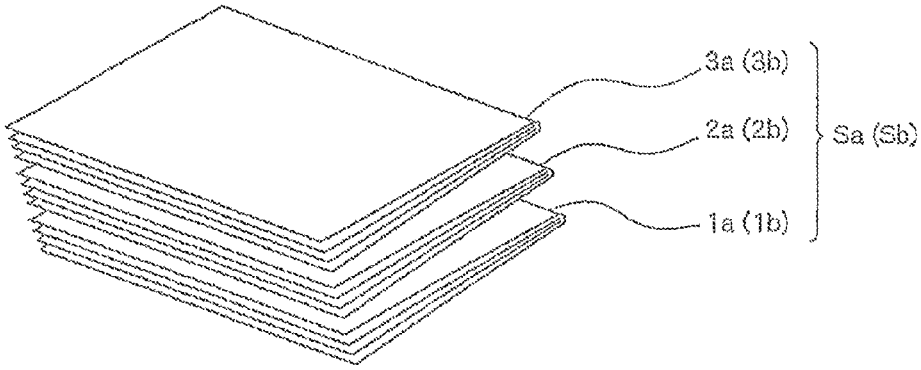
FIG. 3 is a perspective view illustrating a section signature stacking body Sa (Sb) formed by the section signature accumulating apparatus 1 according to the first embodiment.

FIG. 1 is a schematic front view of a section signature accumulating apparatus 1 according to a first embodiment of the present invention. Further, FIG. 2 is an enlarged view of section signature accumulating parts 31 and 32 and a second carrying part 40 of the section signature accumulating apparatus 1 according to the first embodiment illustrated in FIG. 1. In addition, FIG. 3 is a perspective view illustrating a section signature stacking body Sa (Sb) formed by the section signature accumulating apparatus 1 according to the first embodiment.

The section signature accumulating apparatus 1 includes a first carrying part 10 for receiving and carrying a section signature which is delivered from a preprocessing unit F2 on an upstream side and folded in two in a direction perpendicular to a carrying direction, a classifying/carrying part 20 for carrying the section signature transported by the first carrying part 10 to two section signature accumulating parts 31 and 32, and the two section signature accumulating parts 31 and 32 for stocking the section signature carried by the classifying/carrying part 20 and stacking one or a plurality of different types of section signatures to form a section signature stacking body, and a second carrying part 40 for carrying out the section signature stacking body discharged from the section signature accumulating parts 31 and 32.

The first carrying part 10 includes a relay conveyor 11 for receiving the section signature delivered from the preprocessing unit F2, and a speed changing/carrying part 12 continued to a downstream side of the relay conveyor 11.

The relay conveyor 11 is synchronized with a processing speed of the preprocessing unit F2, and may receive and transport the delivered section signatures without changing the carrying speed of the section signatures. Further, as a downstream side of the relay conveyor 11 is inclined to a lower side (a position denoted by a dotted line in FIG. 1) about a shaft of a roller 11*a* by a suitable actuator (not illustrated), an incomplete section signature immediately after an starting of the preprocessing unit F2 may drop into a paper ejection basket Z.

Next to the relay conveyor 11, the speed changing/carrying part. 12 sandwiches and carries the section signature through carrying belts 12*a* and 12*b* installed on upper and lower sides. As the section signature is sandwiched between upper and lower rollers 12*c* and 12*d* on which the carrying belt is laid, a thickness of the section signature is properly deformed by making a folding point of the section signature definite and forcing air between sheets constituting the sections signature out.

Further, the speed changing/carrying part 12 may adjust the section signature transported by the relay conveyor 11 at the same speed as the speed of the section signature delivered from the preprocessing unit F2, to a suitable carrying speed by a control part (not illustrated). Accordingly, in the classifying/carrying part 20 which will be described below, the conveyors 21 and 22 may introduce the section signature into the section signature accumulating part at the suitable speed.

The classifying/carrying part 20 includes the conveyor 21 for carrying a section signature transported by the first carrying part 10 to the section signature accumulating part 31, the conveyor 22 for carrying the section signature to the section signature accumulating part 32, and a classifying unit 23 for classifying the section signature to the conveyor 21 or the conveyor 22.

The classifying unit 23 positions a tip end of a wedge-shaped guide plate 23*b* to a lower side (a position denoted by a solid line in FIG. 1) about a shaft of a roller 23*a* with a suitable actuator (not illustrated) to guide the section signature to the conveyor 22, and positions the tip end of the wedge-shaped guide plate 23*b* to an upper side (a position denoted by a dotted line in FIG. 1) to guide the section signature to the conveyor 21.

In the classifying unit 23, a timing for classifying a section signature to the conveyor 21 or the conveyor 22 is controlled by a control part (not illustrated), based on information on the types (number) of section signatures constituting the section signature stacking body, a timing for delivering the section signature, a carrying speed of the first carrying part 10, and the like. Further, the first one of the two section signatures of the same type continuously delivered from the preprocessing unit F2 may be classified to the conveyor 22, and the next one may be classified to the conveyor 21.

The section signature carrying speeds of the conveyor 21 and the conveyor 22 are synchronized with the above-described speed changing/carrying part 12.

The section signature accumulating part 31 temporarily stocks the section signature transported by the conveyor 21 of the classifying/carrying part. The section signature accumulating part 32 temporarily stocks the section signature transported by the conveyor 22.

The section signature accumulating parts 31 and 32 are installed side by side in a linear shape in the carrying direction of the section signature, and stocks the section signature substantially horizontally, stacks one or plurality of different types of desired section signatures one by one while making four sides thereof coincide with each other, and forms a section signature stacking body.

Each of the section signature accumulating parts 31 and 32 includes four side walls 31*a* to 31*d* and 32*a* to 32*d*, a bottom plates 31*e* and 31*e*', and a bottom plates 32*e* and 32*e*' to accommodate a section signature. The section signature accumulating parts 31 and 32 touch the section signature introduced by the classifying/carrying part 20 on the front side walls 31*a* and 31*b* to stop the section signature, guides the section signature with the four side walls 31*a* to 31*d* and 32*a* to 32*d*, and stacks desired kinds (number) of section signatures while making four sides thereof coincide with each other. Immediately after the section signature stacking body is finished, the bottom plates 31*e* and 31*e*' and the bottom plates 32*e* and 32*e*' are opened to drop the section signature stacking body substantially vertically downward, and the section signature stacking body is positioned on the second carrying part 40.

The bottom plates 31*e* and 31*e*' and the bottom plates 32*e* and 32*e*' are mounted to horizontally slidable guide means 31*f* and 32*f*, for example, such as linear bearings, and as the bottom plate 31*e* is slid to the left direction of FIG. 2 and the bottom plate 31*e*' is slid to the right direction of FIG. 2 by appropriate actuators at the same time, the bottom of the section signature accumulating part 31 is opened to drop the section signature stacking body. Further, the opening mechanism of the bottom plate is not limited to the illustrated form, but the bottom plate may be opened by rotation or angle change in addition to the horizontal slide.

Likewise, as the bottom plates 32*e* and 32*e*' are simultaneously slid to the left and right directions of FIG. 2, the bottom of the section signature accumulating part 32 is opened to drop the section signature stacking body.

Both the bottom plates 31*e* and 31*e*' and the bottom plates 32*e* and 32*e*' are slid in reverse directions of the directions of the opened case after the section signature stacking body drops to close the bottom of the section signature accumulating parts 31 and 32.

The second carrying part is one conveyor or a plurality of conveyors which is continuous in an arranging direction (the same as the carrying direction of the section signature due to the first carrying part 10 and the classifying/carrying part 20) of the section signature accumulating parts 31 and 32 and driven synchronously, and has a first conveyor 41 and a second conveyor 42 in the second carrying part 40 of the first embodiment.

The first conveyor 41 is configured such that a plurality of belts 41*a* lies on pulleys 41*b* to 41*e* in a widthwise direction (a depth direction of FIG. 2), and a suitable interval is present between the adjacent belts.

A guide plate for guiding the section signature stacking body dropping from the section signature accumulating parts 31 and 32 is installed on an upper surface of the first conveyor 41.

A front guide plate 411*a* and a front guide plate 412*a* are installed at locations corresponding to the side walls 31*a* and 32*a* of the section signature accumulating parts 31 and 32, a rear guide plate 411*d* and a rear guide plate 412*d* are installed an locations corresponding to the side walls 31*d* and 32*d*, and left and right guide plates 411*b* and 411*c* and left and right guide plates 412*b* and 412*c* are installed at locations corresponding to the side walls 31*b* and 31*c*, and 32*b* and 32*c*.

The front guide plate 411*a*, the rear guide plate 411*d*, the front guide plate 412*a*, and the rear guide plate 412*d* protrude diagonally on the upper surface of the first conveyor 41 between the plurality of belts 41*a* and 41*a*. The front guide plate 411*a* is mounted to a bracket 411*e* under the belt 41*a*, and the rear guide plate 411*d* is mounted to a bracket 411*f* under the belt 41*a*. The front guide plate 412*a* is mounted to a bracket 412*e* under the belt 41*a*, and the rear guide plate 412*d* is mounted to a bracket 412*f* under the belt 41*a*.

Further, the brackets 411*e*, 411*f*, 412*e*, and 412*f* are supported by suitable actuators (for example, air cylinders) (not illustrated) which are movable vertically. When the section signature stacking body positioned on the first conveyor 41 is carried out, the brackets 411*e*, 411*f*, 412*e*, and 412*f* may be moved downward by operating the actuators, and the front guide plates 411*a* and 412*a* and the rear guide plates 411*d* and 412*d* may be retracted from the upper surface of the first conveyor belt 41, so that they are located not to suppress the section signature stacking body from being carried out.

The second conveyor 42 is driven synchronously with the first conveyor 41, and carries out the section signature stacking body positioned on the first conveyor 41 to the next process (X) in cooperation with the first conveyor 41.

Further, in regard to the guide plates of the second carrying part, any one or both of the front and rear guide plates and the left and right guide plates may be omitted according to a size of the section signature stacking body dropping from the section signature accumulating part or the dropping height of the section signature stacking body.

Further, the locations of the front and rear guide plates which do not suppress the section signature stacking body from being carried to the next process are not limited to the lower side of the conveyor of the second carrying part, and may be lateral sides or an upper side thereof.

Next, steps of repeatedly manufacturing section signatures 1*a* and 1*b*, section signatures 2*a* and 2*b*, and section signatures 3*a* and 3*b*, two of which are delivered continuously in the sequence, forming a section signature stacking body from the delivered section signatures, and carrying out the section signature stacking body to the next process (X) with the preprocessing unit F2 will be described.

In the relay conveyor 11 of the first carrying part 10, an incomplete section signature drops on a paper ejection basket Z, for example, immediately after an starting of the preprocessing unit F2.

Further, first, the section signatures 1*a* and 1*b* are continuously delivered from the preprocessing unit F2. The first carrying part carries the section signatures 1*a* and 1*b* to the classifying/carrying part 20 (a first carrying step).

The section signature 1*a* transported first by the first carrying part is guided to the conveyor 22 by the classifying unit 23, and the section signature 1*b* transported later is guided to the conveyor 21.

The section signature 1*a* transported by the conveyor 22 is introduced into the section signature accumulating part 32, and the section signature 1*b* transported by the conveyor 21 is introduced into the section signature accumulating part 31 (a classifying/carrying step). In this case, carrying speeds of the speed changing/carrying part 12 and the conveyors 22 and 21 are controlled such that a speed at which the section signature is introduced into the section signature accumulating part is within a predetermined speed range (a speed changing/carrying step).

In detail, when the section signatures (in this case, the section signature 1*a* and the section signature 1*b*) are introduced into the section signature accumulating part 32 and the section signature accumulating part 31 from the downstream ends or the conveyors 22 and 21, if the speeds of the section signatures are lower than a predetermined speed range, leading ends of the section signatures may droop down due to their own self-weights thereof, contact the bottom plates 32*e* and 32*e*' and the bottom plates 31*e* and 31*e*' (the very section signature when another section signature is already present in the section signature accumulating part), and the section signatures may be bent or wrinkled without reaching the front side walls 32*a* and 31*a*, before the section signatures are completely discharged from the conveyors 22 and 21. Meanwhile, when the introduction speed is higher than the predetermined speed range, a leading end of the section signature may rapidly collide with the front side walls 32*a* and 31*a*, cause a flaw in the section signature, or be popped from the side walls 32*a* and 31*a* while generating a wrinkle. Thus, when a processing speed of the preprocessing unit F2, that is, a speed of the section signature delivered from the preprocessing unit F2 is lower than the predetermined speed range, the processing speed is increased by the speed changing/carrying part 12, and when being higher than the predetermined speed range, the processing speed is decreased by the speed changing/carrying part 12, such that the section signature may be carried at a speed within the predetermined speed range from the conveyor 22 or 21 to the section signature accumulating part 32 or 31.

Further, an increment and decrement in the speed of the section signature delivered from the preprocessing unit F2 may not be performed by the first carrying part, but may be performed by the conveyor 21 and the conveyor 22 of the classifying/carrying part 20.

In addition, the predetermined speed range is suitably determined according to a paper quality and a size of the section signature, or based on a test or experience by the operator.

The section signature 1*a* is introduced into the section signature accumulating part 32 distant from the preprocessing unit F2, and the section signature 1*b* discharged from behind the section signature 1*a* is introduced into the section signature accumulating part 31 close to the preprocessing unit F2. The section signature accumulating part 32 and the section signature accumulating part 31 are installed at a suitable interval, and thus there is no large time gap between the timing when the section signature 1*a* is introduced into the section signature accumulating part 32 and the timing when the section signature 1*b* is introduced into the section signature accumulating part 31.

Subsequently, the section signatures 2*a* and 2*b* are continuously delivered from the preprocessing unit F.

The section signature 2*a* transported first by the first carrying part is guided to the conveyor 22 by the classifying unit 23, and the section signature 2*b* transported later is guided to the conveyor 21.

The section signature 2*a* transported by the conveyor 22 is introduced into the section signature accumulating part 32, and the section signature 2*b* transported by the conveyor 21 is introduced into the section signature accumulating part 31. The section signature 1*a* has already entered the section signature accumulating part 32, and thus the section signature 2*a* overlaps the section signature 1*a*. The section signature 1*b* has already entered the section signature accumulating part 31, and thus the section signature 2*b* overlaps the section signature 1*b*.

Subsequently, the section signatures 3*a* and 3*b* are continuously discharged from the preprocessing unit F.

The section signature 3*a* transported first by the first carrying part is guided to the conveyor 22 by the classifying unit 23, and the section signature 3*b* transported later is guided to the conveyor 21.

The section signature 3*a* transported by the conveyor 22 is introduced into the section signature accumulating part 32, and the section signature 3*b* transported by the conveyor 21 is introduced into the section signature accumulating part 31. The section signature 1*a* and the section signature 2*a* overlapping thereon have already entered the section signature accumulating part 32, and thus the section signature 3*a* overlaps the section signature 2*a* further. The section signature 1*b* and the section signature 2*b* overlapping thereon have already entered the section signature accumulating part 31, and thus the section signature 3*b* overlaps the section signature 2*b* further.

In this way, a section signature stacking body Sa where the section signature 1*a*, the section signature 2*a*, and the section signature 3*a* overlap each other from the bottom is formed in the section signature accumulating part 32, and a section signature stacking body Sb where the section signature 1*b*, the section signature 2*b*, and the section signature 3*b* are stacked from the bottom is formed in the section signature accumulating part 31 (a section signature accumulating step).

If the section signature stacking body Sa is formed, the section signature accumulating part 32 opens the bottom plates 32*e* and 32*e*'. Further, the section signature stacking body Sa drops at a predetermined location directly below the section signature accumulating part 32 on the first conveyor 41 of the second carrying part 40 which is stopped in a standby state. If the section signature stacking body Sb is formed, the section signature accumulating part 31 opens the bottom plates 31*e* and 31*e*'. In addition, the section signature stacking body Sb also drops at a predetermined location directly below the section signature accumulating part 31 on the first conveyor 41 of the second carrying part 40 which is stopped in a standby state. The front guide plate 412*a*, the rear guide plate 412*d*, and the left and right guide plates 412*b* and 412*c* which guide the dropping section signature stacking body Sa, and the front guide plate 411*a*, the rear guide plate 411*d*, and the left and right guide plates 411*b* and 411*c* which guide the section signature stacking body Sb are installed respectively at the predetermined locations of the first conveyor 41, and thus the section signatures which are stacked while the four sides thereof coincide with each other never deviate.

Both the two section signature stacking bodies Sa and Sb drop on the first conveyor 41 substantially simultaneously, and the front guide plate 411*a*, the rear guide plate 411*d*, the front guide plate 412*a*, and the rear guide plate 412*d* are moved downward after a lapse of a minute time (below approximately 1 second) for bounds of the section signature stacking bodies Sa and Sb due to drop shocks, and the section signature stacking bodies Sa and Sb are retracted from the upper surface of the first conveyor 41. Further, the first conveyor 41 and the second conveyor 42 of the second carrying part 40 carry out the two section signature stacking bodies Sa and Sb toward the next process X (a second carrying step). If the two section signature stacking bodies Sa and Sb are completely carried out, the second carrying part 40 stops driving the first conveyor 41 and the second conveyor 42, protrudes the front guide plate 411*a*, the rear guide plate 411*d*, and the front guide plates 412*a* and 412*d* from the upper surface of the first conveyor 41, and stands by until the section signature stacking body formed next drops.

Although the steps have been described until the two section signature stacking bodies Sa and Sb are finished and carried out to the next process, the section signatures 1*a*, 1*b*, 2*a*, 2*b*, 3*a*, and 3*b* are sequentially manufactured and delivered from the preprocessing unit F2, and thus the section signature accumulating apparatus 1 processes the section signatures without delaying them, and forms and carries out section signature stacking bodies.

Further, although a section signature stacking body is formed by overlapping three kinds of section signatures in the above-described first embodiment, the number (kinds) of section signatures constituting the section signature stacking body is not limited to the first embodiment.

In addition, for example, in order to manufacture a memo pad or a note, a section signature stacking body may be formed by overlapping a plurality of the same kind of section signatures.

In the above-described preprocessing unit F2, the same kind of section signatures are delivered two by two, but for example, when the same kind of section signatures are delivered three by three, as a section signature accumulating apparatus for processing the section signatures delivered three by three, a section signature accumulating apparatus 2 having three section accumulating parts according to the second embodiment as will be described below may be configured. Hereinafter, the section signature accumulating apparatus 2 according to the second embodiment will be described.

Figure 4:
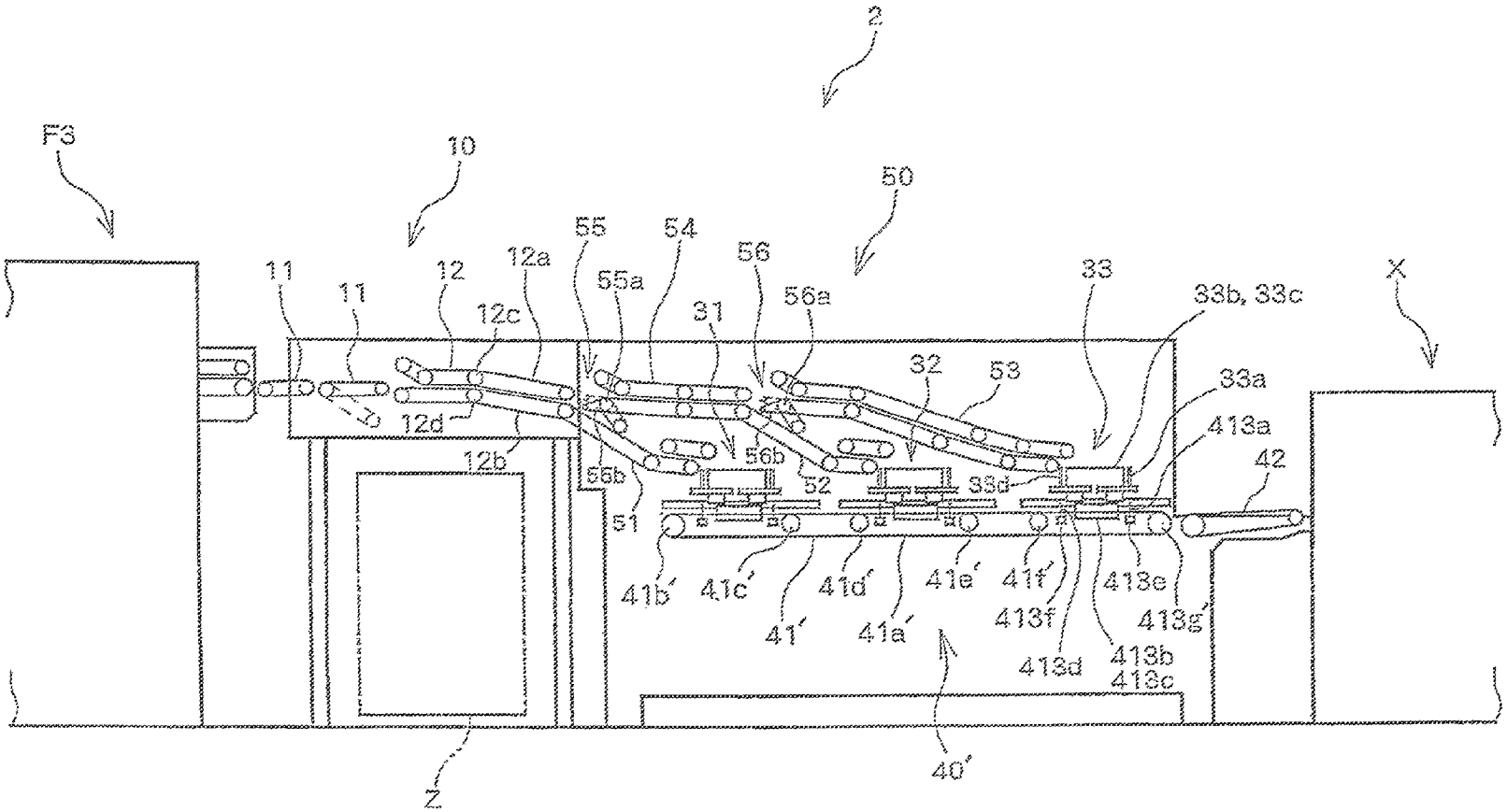
FIG. 4 is a schematic front view of a section signature accumulating apparatus 2 according to a second embodiment.
Figure 5:
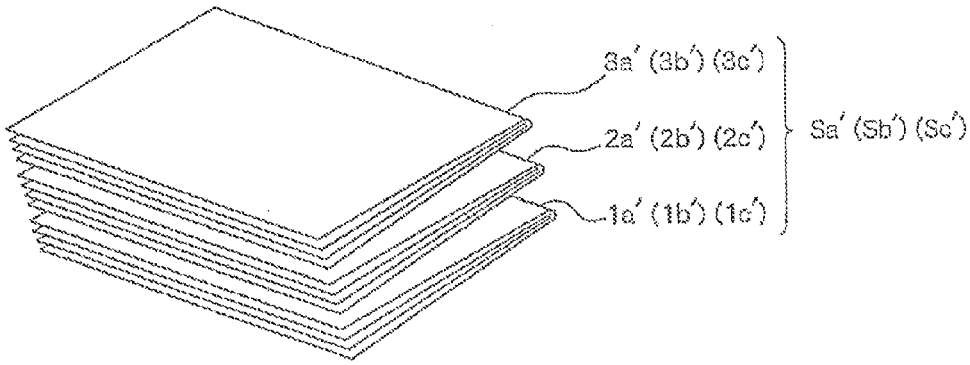
FIG. 5 is a perspective view illustrating a section signature stacking body Sa' (Sb' and Sc') formed by the section signature accumulating apparatus 2 according to the second embodiment.

Here, FIG. 4 is a schematic front view of a section signature accumulating apparatus 2 according to the second embodiment. FIG. 5 is a perspective view illustrating a section signature stacking body Sa' (Sb' and Sc') formed by the section signature accumulating apparatus 2 according to the second embodiment. Further, the members that are the same as or similar to the section signature accumulating apparatus 1 of the above-described first embodiment will be denoted by the same reference numerals and a detailed description thereof will not be repeated.

The preprocessing unit F3 delivers the same kind of section signatures folding-in-two in a direction perpendicular to the carrying direction three by three. A first carrying part 10 for receiving and carrying the section signature delivered from the preprocessing unit F3 is the same as in the section signature accumulating apparatus 1.

A classifying/carrying part 50 includes conveyors 51, 52, 53, and 54 and classifying units 55 and 56.

The classifying unit 55 classifies the section signatures transported by the first carrying part 10 to the conveyor 54 or the conveyor 51. The classifying unit 55 positions a tip end of a wedge-shaped guide plate 55*b* to a lower side (a position denoted by a solid line in FIG. 4) about a shaft of a roller 55*a* with a suitable actuator (not illustrated) to guide the section signature to the conveyor 54, and positions the tip end of the wedge-shaped guide plate 55*b* to an upper side (a position denoted by a dotted line in FIG. 4) to guide the section signature to the conveyor 51.

The conveyor 54 carries the section signature toward the classifying unit 56, and the conveyor 51 carries the section signature to the section signature accumulating part 31.

The classifying unit 56 classifies the section signatures transported by the conveyor 54 to the conveyor 53 or the conveyor 52. The classifying unit 56 positions a tip end of a wedge-shaped guide plate 56*b* to a lower side (a position denoted by a solid line in FIG. 4) about a shaft of a roller 56*a* with a suitable actuator (not illustrated) to guide the section signature to the conveyor 53, and positions the tip end of the wedge-shaped guide plate 55*b* to an upper side (a position denoted by a dotted line in FIG. 4) to guide the section signature to the conveyor 52.

The conveyor 53 carries the section signature to the section signature accumulating part 33, and the conveyor 52 carries the section signature to the section signature accumulating part 32.

In the classifying units 55 and 56, a timing for classifying a section signature is controlled by a control part (not illustrated), based on information on the types (number) of section signatures constituting the section signature stacking body, a timing for delivering the section signature, a carrying speed of the first carrying part 10, and the like. Further, the first one of the three section signatures of the same type continuously discharged from the preprocessing unit F3 is classified to the conveyor 53 via the conveyor 54, the second one is classified to the conveyor 52 via the conveyor 54, and the third one is classified to the conveyor 51 in sequence.

The section signature carrying speeds of the conveyors 51 to 54 are synchronized with the speed changing/carrying part 12.

The section signature accumulating part 31 temporarily stocks the section signature transported by the conveyor 51 of the classifying/carrying part. The section signature accumulating part 32 temporarily stocks the section signature transported by the conveyor 52. The section signature accumulating part 33 temporarily stocks the section signature transported by the conveyor 53.

The section signature accumulating parts 31, 32, and 33 are installed side by side in a linear shape in the carrying direction of the section signature, and stock the section signatures substantially horizontally, stack one or plurality of different types of desired section signatures one by one while making four sides thereof coincide with each other, and form section signature stacking bodies.

Like the section signature accumulating parts 31 and 32, the section signature accumulating part 33 also has four side walls 33*a* to 33*d* and bottom plates 33*e* and 33*e*' to accommodate a section signature. Like the bottom plates 31*e* and 31*e*' and the bottom plates 32*e* and 32*e*', the bottom plates 33*e* and 33*e*' are slid horizontally to open the bottom of the section signature accumulating part 33.

Further, the section signature accumulating part 33 touches the section signature introduced by the classifying/carrying part on a front side wall 33*a* to stop the section signature, guides the section signature with the four side walls 33*a* to 33*d*, and stacks desired kinds of section signatures while making four corresponding sides coincide with each other. Immediately after the section signature stacking body is finished, the bottom plates 33*e* and 33*e*' are opened to drop the section signature stacking body substantially vertically downward, and the section signature stacking body is positioned on the second carrying part 40'. After the section signature stacking body drops, the bottom plates 33*e* and 33*e*' close the bottom of the section signature accumulating part 33.

The second carrying part 40' has a first conveyor 41' and a second conveyor 42. The first conveyor 41' is configured such that a plurality of belts 41*a*' lies on pulleys 41*b*' to 41*g*' in the same width direction (a depth direction of FIG. 5) as that of the first conveyor 41 of the section signature accumulating apparatus 1, and a suitable interval is present between the adjacent belts.

A guide plate for guiding the section signature stacking body dropping from the section signature accumulating parts 31, 32, and 33 is installed on an upper surface of the first conveyor 41'.

Like in the first conveyor 41 of the section signature accumulating apparatus 1, a front guide plate 411*a*, a rear guide plate 411*d*, left and right guide plates 411*b* and 411*c*, a front guide plate 412*a*, a rear guide plate 412*d*, and left and right guide plates 412*b* and 412*c* are installed under the section signature accumulating parts 31 and 32, and the front guide plate 411*a*, the rear guide plate 411*d*, the front guide plate 412*a*, and the rear guide plate 412*d* are mounted to a bracket 411*e*, a bracket 411*f*, a bracket 412*e*, and a bracket 412*f*, under the belt 41*a*', respectively and are movable vertically.

Likewise, the front guide plate 413*a* is installed at a location corresponding to the side wall 33*a* of the section signature accumulating part 33, the rear guide plate 413*d* is installed at a location corresponding to the side wall 33*d* thereof, and the left and right guide plates 413*b* and 413*c* are installed at locations corresponding to the side walls 33*b* and 33*c* thereof.

The front guide plate 413*a* and the rear guide plate 413*d* also protrude diagonally on the upper surface of the first conveyor 41' between the plurality of belts 41*a'* and 41*a'*. Further, the front guide plate 413*a* is mounted to a bracket 413*e* under the belt 41*a'*, and the rear guide plate 413*d* is mounted to a bracket 413*f* under the belt 41*a'*.

Further, the brackets 413*e* and 413*f* are supported by suitable actuators (for example, air cylinders) (not illustrated) which are movable vertically. When the section signature stacking body positioned on the first conveyor 41' is carried, the brackets 411*e*, 411*f*, 412*e*, 412*f*, 413*e*, and 413*f* may be moved downward, and the front guide plate 411*a*, the rear guide plate 411*d*, the front guide plate 412*a*, the rear guide plate 412*d*, the front guide plate 413*a*, and the rear guide plate 413*d* may be retracted from the upper surface of the first conveyor 41', so that they are located not to suppress the section signature stacking body from being carried out.

The second conveyor 42 is driven synchronously with the first conveyor 41', and carries out the section signature stacking body positioned on the first conveyor 41' to the next process (X) in cooperation with the first conveyor 41'.

Next, steps of forming a section signature stacking body from three kinds of section signatures 1*a'*, 1*b'*, and 1*c'*, section signatures 2*a'*, 2*b'*, and 2*c'*, and section signatures 3*a'*, 3*b'*, and 3*c'*, which are delivered three by three with the preprocessing unit F3, and carrying out the section signature stacking body to the next process with the section signature accumulating apparatus 3 will be described.

In the relay conveyor 11 of the first carrying part, an incomplete section signature drops on a paper ejection basket Z, for example, immediately after an starting of the preprocessing unit F3.

Further, first, the section signature 1*a'*, the section signature 1*b'*, and the section signature 1*c'* are continuously delivered from the preprocessing unit F3 in the sequence. The first carrying part carries the section signatures 1*a'*, 1*b'*, and 1*c'* to the classifying/carrying part 50 (a first carrying step).

The section signature 1*a'* transported first by the first carrying part is guided to the conveyor 54 by the classifying unit 55, and is guided to the conveyor 53 by the classifying unit 56.

A subsequently transported section signature 1*b'* is guided to the conveyor 54 by the classifying unit 55, and is guided to the conveyor 52 by the classifying unit 56.

A subsequently transported section signature 1*c'* is guided to the conveyor 51 by the classifying unit 55.

The section signature 1*a'* transported by the conveyor 53 is introduced into the section signature accumulating part 33, the section signature 1*b'* transported by the conveyor 52 is introduced into the section signature accumulating part 32, and the section signature 1*c'* transported by the conveyor 51 is introduced into the section signature accumulating part 31 (a classifying/carrying step). Then, like in the section signature accumulating apparatus 1, carrying speeds of the speed changing/carrying part 12 and the conveyors 51 to 54 are controlled such that a speed at which the section signature is introduced into the section signature accumulating part is within a predetermined speed range (a speed changing/carrying step).

The section signature 1*a'* is introduced into the section signature accumulating part 33 most distant from the preprocessing unit F3, the section signature 1*b'* is introduced into the section signature accumulating part 32 the second most distant from the preprocessing unit F3, and the section signature 1*c'* is introduced into the section signature accumulating part 31 closest to the preprocessing unit F3. The section signature accumulating parts 33 to 31 are installed at a suitable interval, and thus there is no large time gap among the timing when the section signature 1*a'* is introduced into the section signature accumulating part 33, the timing when the section signature 1*b'* is introduced into the section signature accumulating part 32, and the timing when the section signature 1*c'* is introduced into the section signature accumulating part 31.

Further, the section signature 2*a'*, the section signature 2*b'*, and the section signature 2*c'* are continuously delivered from the preprocessing unit F3 in the sequence.

The section signature 2*a'* transported first by the first carrying part is guided to the conveyor 54 by the classifying unit 55, and is guided to the conveyor 53 by the classifying unit 56.

The subsequently transported section signature 2*b'* is guided to the conveyor 54 by the classifying unit 55, and is guided to the conveyor 52 by the classifying unit 56.

The subsequently transported section signature 2*b'* is guided to the conveyor 51 by the classifying unit 55.

The section signature 2*a'* transported by the conveyor 53 is introduced into the section signature accumulating part 33, the section signature 2*b'* transported by the conveyor 52 is introduced into the section signature accumulating part 32, and the section signature 2*c'* transported by one conveyor 51 is introduced into the section signature accumulating part 31. The section signature 1*a'* has already entered the section signature accumulating part 33, and thus the section signature 2*a'* overlaps the section signature 1*a'*. The section signature 1*b'* has already entered the section signature accumulating part 32, and thus the section signature 2*b'* overlaps the section signature 1*b'*. The section signature 1*c'* has already entered the section signature accumulating part 31, and thus the section signature 2*c'* overlaps the section signature 1*c'*.

Further, the section signature 3*a'*, the section signature 3*b'*, and the section signature 3*c'* are continuously delivered from the preprocessing unit F3 in the sequence.

The section signature 3*a'* transported first by the first carrying part is guided to the conveyor 54 by the classifying unit 55, and is guided to the conveyor 53 by the classifying unit 56.

The subsequently transported section signature 3*b'* is guided to the conveyor 54 by the classifying unit 55, and is guided to the conveyor 52 by the classifying unit 56.

The subsequently transported section signature 3*c'* is guided to the conveyor 51 by the classifying unit 55.

The section signature 3*a'* transported by the conveyor 53 is introduced into the section signature accumulating part 33, the section signature 3*b'* transported by the conveyor 52 is introduced into the section signature accumulating part 32, and the section signature 3*c'* transported by the conveyor 51 is introduced into the section signature accumulating part 31. The section signature 1*a'* and the section signature 2*a'* overlapping thereon have already entered the section signature accumulating part 33, and thus the section signature 3*a'* overlaps the section signature 2*a'* further. Further, the section signature 1*b'* and the section signature 2*b'* overlapping thereon have already entered the section signature accumulating part 32, and thus the section signature 3*b'* overlaps the section signature 2*b'* further. In addition, the section signature 1*c'* and the section signature 2*c'* overlapping thereon have already entered the section signature accumulating part 31, and thus the section signature 3*c'* overlaps the section signature 2*c'* further.

In this way, a section signature stacking body Sa' where the section signature 1*a'*, the section signature 2*a'*, and the section signature 3*a'* are stacked from the bottom is formed in the section signature accumulating part 33, a section signature stacking body Sb' where the section signature 1*b'*, the section signature 2*b*', and the section signature 3*b*' are stacked from the bottom is formed in the section signature accumulating part 32, and a section signature stacking body Sc' where the section signature 1*c*', the section signature 2*c*', and the section signature 3*c*' are stacked from the bottom is formed in the section signature accumulating part 31 (a section signature accumulating step).

If the section signature stacking body Sa' is formed, the section signature accumulating part 33 opens the bottom plates 33*e* and 33*e*'. Further, the section signature stacking body Sa' drops at a predetermined location directly below the section signature accumulating part 33 on the first conveyor 41' of the second carrying part 40' which is stopped in a standby state.

If the section signature stacking body Sb' is formed, the section signature accumulating part 32 opens the bottom plates 32*e* and 32*e*'. Further, the section signature stacking body Sb' also drops at a predetermined location directly below the section signature accumulating part 32 on the first conveyor 41' of the second carrying part 40' which is stopped in a standby state.

If the section signature stacking body Sc' is formed, the section signature accumulating part 31 opens the bottom plates 31*e* and 31*e*'. Further, the section signature stacking body Sc' also drops at a predetermined location directly below the section signature accumulating part 31 on the first conveyor 41' of the second carrying part 40' which is stopped in a standby state.

The front guide plate 413*a*, the rear guide plate 413*d*, and the left and right guide plates 413*b* and 413*c* which guide the dropping section signature stacking body Sa', the front guide plate 412*a*, the rear guide plate 412*d*, and the left and right guide plates 412*b* and 412*c* which guide the dropping section signature stacking body Sb' and the front guide plate 411*a*, the rear guide plate 411*d*, and the left and right guide planes 411*b* and 411*c* which guide the dropping section signature stacking body Sc' are installed at the predetermined locations of the first conveyor 41', and thus the section signatures which are stacked while the four sides thereof coincide with each other never deviate.

The three section signature stacking bodies Sa', Sb', and Sc' drop on the first conveyor 41' substantially simultaneously, and the front guide plate 411*a*, the rear guide place 411*d*, the front guide plate 412*a*, the rear guide plate 412*d*, the front guide plate 413*a*, and the rear guide plate 413*d* are moved downward collectively after a small lapse in time (below approximately 1 second) for bounds of the section signature stacking bodies Sa', Sb', and Sc' due to drop shocks, and the section signature stacking bodies Sa', Sb', and Sc' are retracted from the upper surface of the first conveyor 41'. Further, the first conveyor 41' and the second conveyor 42 of the second carrying part 40' carry out the three section signature stacking bodies Sa', Sb', and Sc' toward the next process X (a second carrying step). If all the three section signature stacking bodies Sa', Sb', and Sc' are carried out to the next process X, the second carrying part 40' stops driving the first conveyor 41' and the second conveyor 42, protrudes the front guide plate 411*a*, the rear guide plate 411*d*, the front guide plate 412*a*, the rear guide plate 412*d*, the front guide plates 413*a* and the rear guide plate 413*d* from the upper surface of the first conveyor 41', and stands by until the section signature stacking body formed next drops.

Although the steps have been described until the three section signature stacking bodies Sa', Sb', and Sc' are finished and carried out to the next process, the section signatures 1*a*', 1*b*', 1*c*', 2*a*', 2*b*', 2*c*', 3*a*', 3*b*', and 3*c*' which are section print products are sequentially manufactured and delivered from the preprocessing unit F3, and thus the section signature accumulating apparatus 2 processes the section signatures without delaying them, forms the section signature stacking bodies and carries out the section signature stacking bodies to the next process X.

Although the preferred embodiments of the present invention have been described above, the technical scope of the present invention is not limited to the scopes described in the embodiments. The embodiments may be variously modified and improved.

For example, the function of the first carrying part may be realized by a section signature delivering part of the preprocessing unit.

In the case of a preprocessing unit where the same kind of section signatures are delivered N by N, N section signature stacking bodies where one or a plurality of section signatures is stacked may be formed by installing N section signature accumulating parts on a downstream side from a first carrying part, classifying and carrying the section signatures transported by the first carrying part to N different section signature accumulating parts one by one by a classifying/carrying part, and stocking the section signatures carried by the classifying/carrying part in the section signature accumulating part.

Further, a time gap between timings when the section signatures reach the section signature accumulating parts is made small and section signature stacking bodies are finished substantially simultaneously in the section signature accumulating parts by installing the N section signature accumulating parts side by side at a suitable interval in the same direction as the carrying direction of the section signatures delivered from the preprocessing unit and classifying and carrying the section signatures from the section signature accumulating part distant from the preprocessing unit to the section signature accumulating part close to the preprocessing unit in the sequence by a classifying/carrying part. Thus, in the second carrying part, the section signature stacking bodies drop to be mounted substantially simultaneously from the N section signature accumulating parts, and thus the section signature stacking bodies can be carried out to the next process by one carrying part (second carrying part).

In addition, the section signature is not limited to those folded in two in a direction perpendicular to the carrying direction. For example, the section signatures may be folded in two in a direction parallel to the carrying direction, or may be folded in two and then four in a direction perpendicular to the carrying direction or folded in plural.

As an example of the next process, when a chopper folding apparatus is connected to a downstream side of the second carrying part, the section stacking body can be folded in two in a direction perpendicular to a folding line of a section print product to form a multi-section signature gathered into one by the outermost section signature by feeding the section stacking body continuously delivered from the second carrying part at a predetermined interval (the interval of the section accumulating part) onto a chopper table of the chopper folding unit and entering the section stacking body between folding rollers of the chopper tables with a chopper blade in sequence.

It is apparent from the description of the claims that the modifications or improvements as described above also can fall within the technical scope of the present invention.

REFERENCE SIGNS LIST

1, 2: Section signature accumulating apparatus
10: First carrying part

11: Relay conveyor
11*a*: Roller
12: Speed changing/carrying part
12*a*, 12*b*: Carrying belts
12*c*, 12*d*: Rollers
20, 50: Classifying/carrying parts
21, 22, 51, 52, 53, 54: Conveyors
23, 55, 56: Classifying units
23*a*, 55*a*, 56*a*: Rollers
23*b*, 55*b*, 56*b*: Guide plates
31, 32, 33: Section signature accumulating part
40, 40': Second carrying parts
41, 41': First conveyors
42: Second conveyor
41*a*, 41*a*': Belts
41*b*, 41*c*, 41*d*, 41*e*, 41*b*', 41*c*', 41*d*', 41*e*', 41*f*', 41*g*': Pulleys
411*a*, 412*a*, 413*a*: Front guide plates
411*b*, 411*c*, 412*b*, 412*c*, 413*b*, 413*c*: Left and right guide plates
411*d*, 412*d*, 413*d*: Rear guide plates
411*e*, 411*f*, 412*e*, 412*f*, 413*e*, 413*f*: Brackets
F2, F3: Preprocessing units
X: Next process
Z: Paper ejection basket

The invention claimed is:

1. A section signature accumulating apparatus for manufacturing a plurality of kinds of an at least folding-in-two sections signature with one sheet or a plurality of overlaid sheets, and stacking the plurality of kinds of manufactured section signatures to form and carry out a newspaper form print product, comprising:

a preprocessing unit controlled to continuously manufacture N (N is an integer equal to or larger than 2) copies of a leading section signature and then continuously manufacture N copies of at least one kind of a following section signature which is of a different kind of the leading section signature:

a first carrying part controlled to receive and carry continuously and sequentially the N copies of the leading section signature and the N copies of the following section signature delivered from the preprocessing unit;

N section signature accumulating parts installed side by side at a suitable interval in the same direction as a carrying direction of the section signatures;

a classifying/carrying part installed between the first carrying part and the N section signature accumulating parts a second carrying parts; and a control part that controls the classifying/carrying part that the N copies of the leading section signature carried to the classifying/carrying part by the first carrying part are classified and carried to each of the N section signature accumulating parts one copy at a time, and controls the classifying/carrying part such that the N copies of the following section signature subsequently carried to the classifying/carrying part by the first carrying part are classified and carried to each of the N section signature accumulating parts one at a time, wherein each of the section signature accumulating parts is configured to stock the leading section signatures carried by the classifying/carrying part and overlay the following section signatures subsequently carried by the classifying/carrying part on the leading section signatures to form a newspaper form print product where a plurality of kinds of section signatures are stacked, wherein the second carrying part is controlled to carry out N copies of the newspaper form print product discharged from the N section signature accumulating parts, respectively, to the next process, and wherein the control part controls the classifying/carrying part such that the respective leading section signatures and following section signatures are sequentially classified and carried from the section signature accumulating part located at a downstream side in the carrying direction to the section signature accumulating part located at an upstream side.

2. The section signature accumulating apparatus of claim 1, further comprising:

a speed changing/carrying part configured to change speeds of the manufactured leading section signatures and following section signatures to suitable speeds before the leading section signatures and following section signatures are carried to the section signature accumulating parts to carry the leading section signatures and following section signatures.

3. A section signature accumulating method of manufacturing a plurality of kinds of an at least folding-in-two sections signature with one sheet or a plurality of overlaid sheets, and stacking the plurality of kinds of manufactured section signatures to form and carry out a newspaper form print product. comprising:

a preprocessing step of continuously manufacturing N (N is an integer equal to or larger than 2) copies of a leading section signature and then continuously manufacturing N copies of at least one kind of a following section signature which is of a different kind to the leading section signature;

a first carrying step of receiving and carrying continuously and sequentially the delivered N copies of the leading section signatures and N copies of the following section signature;

a classifying/carrying step of classifying and carrying the leading section signatures to each of N section signature accumulating parts one copy at a time, and then classifying and carrying the following section signatures to each of the N section signature accumulating parts one copy at a time:

a section signature accumulating step of stocking the classified and carried leading section signatures and overlaying subsequently classified and carried following section signatures to form newspaper form print product where a plurality of kinds of section signatures are stacked in the section signature accumulating parts, respectively; and a second carrying step of carrying out the formed N copies of the newspaper form print product to the next process, wherein the classifying/carrying step is a processing that causes a classifying/carrying part installed at an upstream side of the section accumulating parts to execute a processing on the N section signature accumulating parts installed side by side at a suitable interval in the same direction as a carrying direction of the section signatures, by control of a control part, the processing sequentially classifying and carrying the leading section signatures from the section signature accumulating part located at a downstream side in the carrying direction to the section signature accumulating part located at an upstream side, and then sequentialy classifying and carrying the following section signatures from the section signature accumulating part located at a downstream side to the section signature accumulating part located at an upstream side.

4. The section signature accumulating method of claim 3, wherein any one of the first carrying step and the classifying/ carrying step includes a speed changing/carrying step of changing carrying speeds of the leading section signatures and the following section signatures.

* * * * *